US006405629B1

(12) United States Patent
Beckmann et al.

(10) Patent No.: US 6,405,629 B1
(45) Date of Patent: Jun. 18, 2002

(54) AMMUNITION MAGAZINE FOR BELTLESS FED AMMUNITION

(75) Inventors: Rudi Beckmann, Aichhalden; Michael Schumacher, Fluorn-Winzeln, both of (DE)

(73) Assignee: Heckler & Koch GmbH (DE)

( * ) Notice: Subject to any disclaimer, the term of this patent is extended or adjusted under 35 U.S.C. 154(b) by 0 days.

(21) Appl. No.: 09/493,571

(22) Filed: Jan. 28, 2000

Related U.S. Application Data

(60) Provisional application No. 60/163,495, filed on Nov. 4, 1999, and provisional application No. 60/163,533, filed on Nov. 4, 1999.

(30) Foreign Application Priority Data

Jan. 28, 1999 (DE) ..... 199 03 346

(51) Int. Cl.[7] ..... F41A 9/00
(52) U.S. Cl. ..... 89/33.17; 89/33.16; 89/33.25
(58) Field of Search ..... 89/33.16, 33.17, 89/33.25, 33.5, 45

(56) References Cited

U.S. PATENT DOCUMENTS 4,504,251 A * 3/1985 Mittermeier ..... 474/110
4,573,395 A 3/1986 Stoner ..... 89/33.16
5,408,915 A * 4/1995 Stoner ..... 89/33.14
5,571,984 A * 11/1996 Ferrand ..... 89/33.16

FOREIGN PATENT DOCUMENTS

AT WO-9834768 A * 8/1998
DE 36 44 513 C2 6/1988
EP 078482 B1 5/1983

* cited by examiner

*Primary Examiner*—Peter M. Poon
*Assistant Examiner*—Floris C. Copier
(74) *Attorney, Agent, or Firm*—Marshall, Gerstein & Borun

(57) ABSTRACT

An ammunition magazine for beltless fed ammunition is disclosed. The magazine includes at least one endlessly guided ammunition guide chain to transport ammunition, and a chain tightener to tighten the ammunition guide chain with a predetermined chain tension. The chain tightener carries out a clamping movement in the direction of tightening to increase the chain tension and carries out a clamping movement against the direction of tightening to reduce the chain tension. To prevent slack from developing, (for example, during acceleration of the ammunition guide chain), the chain tightener is provided with a brake to influence the spring constant of the chain tightener as a function of the direction of tightening and the speed of the clamping movement.

26 Claims, 5 Drawing Sheets

AMMUNITION MAGAZINE FOR BELTLESS FED AMMUNITION

RELATED APPLICATION

This patent claims priority from: (a) U.S. Provisional Patent Application Serial No. 60/163,495, which was filed Nov. 4, 1999 and which is hereby incorporated by reference in its entirety; and (b) U.S. Provisional Patent Application Serial No. 60/163,533, which was filed on Nov. 4, 1999 and which is hereby incorporated in its entirety by reference.

FIELD OF THE INVENTION

The invention relates generally to ammunition magazines, and, more particularly, to a chain tightener for an ammunition magazine.

BACKGROUND OF THE INVENTION

Ammunition magazines of the type disclosed herein are generally known from EP-078 482 B1. In that document, ammunition is transported by an endless ammunition guide chain in several loops which are guided around deflection rollers through the ammunition magazine. A tension spring acts on one of the deflection rollers. This tension spring forces the loop guided around this deflection roller outward, so that the ammunition guide chain is tightened during a clamping movement of this spring (i.e., disengagement movement), whereas it is released during a movement of the spring opposite its direction of tightening (i.e., engagement movement).

A drawback of this tightening system lies in the fact that the spring force can be overcome during acceleration of the ammunition guide chain, such that the spring engages and the ammunition guide chain is, consequently, released. This ability to overcome the spring force is primarily due to the fact that the spring constant must be dimensioned correspondingly low. If the tightening force exerted by the spring changes during heat-related material expansions, when the ammunition guide chain engages or disengages according to the expansion movements, the resulting tightening force of the spring must not be too strong or too weak, so that the material of the ammunition guide chain is not stressed too strongly.

An ammunition magazine with a beltless fed, endless ammunition guide chain is also known from DE-36 44 513 C2. In that reference, two opposite short loops of the ammunition guide chain, (one of which is coupled to an ammunition transfer device), are guided to move in the direction of transport. The displacement movement is supported by a prestressed gas pressure spring. The drive unit of the ammunition guide chain is situated in this short loop with the connected ammunition transfer device, so that during acceleration or braking of the ammunition guide chain, initially only the inert mass of the short loop must be moved. Movement of the rest of the ammunition guide chain is only disengaged once by the displaceable loops. Short acceleration times with comparatively weakly dimensioned drive units can thus be achieved. However, this document does not describe the tightener in detail, with which the chain tension of the ammunition guide chain can be adjusted.

A similar principle is known from U.S. Pat. 4,573,395, in which a short bend is disconnected from the movement of the rest of the ammunition guide chain. In this case, however, two loops of this bend do not lie opposite each other and are not guided to move in the direction of feed, but lie parallel to each other and are connected over the two ends of a rocker. The two parallel loops therefore always execute oppositely directed movements via this rigid motion coupling.

A shortcoming of the known ammunition magazines with chain tighteners is that the chain tightener executes engagement or disengagement movements, especially during acceleration or braking of the ammunition guide chain, in which mostly undesired slack can occur in the ammunition guide chain.

SUMMARY OF THE INVENTION

In accordance with an aspect of the invention, an ammunition magazine is disclosed for use with beltless fed ammunition. The ammunition magazine includes an endless, guided ammunition guide chain to convey ammunition within the magazine. It also includes a chain tightener having a spring constant and being operatively coupled to the ammunition guide chain. The chain tightener executes a movement in a direction of tightening to increase chain tension in at least a portion of the guide chain and executes a movement opposite the direction of tightening to reduce chain tension in at least a portion of the guide chain. The ammunition magazine also includes means for effectively adjusting the spring constant of the chain tightener as a function of the direction of movement of the chain tightener and as a function of a speed of movement of the chain tightener.

In accordance with another aspect of the invention, an ammunition magazine is disclosed. The ammunition magazine includes an ammunition guide chain to convey ammunition within the magazine. It also includes a chain tightener having a spring constant and being operatively coupled to the guide chain. The chain tightener executes a movement in a first direction to increase chain tension in at least a portion of the guide chain and executes a movement in a second direction substantially opposite the first direction to reduce tension in at least a portion of the guide chain. The ammunition magazine further includes a brake cooperating with the chain tightener to effectively increase the spring constant of the chain tightener in response to forces which, in the absence of the brake, would move the chain tightener in the second direction at a speed above a predetermined threshold.

In accordance with still another aspect of the invention, an ammunition magazine is provided. The ammunition magazine includes an ammunition guide chain to convey ammunition within the magazine and a chain tightener. The chain tightener has a spring constant and is operatively coupled to the guide chain. The chain tightener executes a movement in a first direction to increase chain tension in at least a portion of the guide chain and executes a movement in a second direction substantially opposite the first direction to reduce tension in at least a portion of the guide chain. The ammunition magazine is also provided with a brake operatively coupled to the chain tightener. The brake substantially prevents movement of the chain tightener in the second direction at speeds above a first predetermined threshold, but the brake does not substantially interfere with (a) movement of the chain tightener in the first direction and (b) movement of the chain tightener in the second direction at speeds below a second predetermined threshold.

In accordance with still another aspect of the invention, an ammunition magazine is provided for use with beltless fed ammunition. The ammunition magazine includes an endless, guided ammunition guide chain to convey ammunition within the magazine. It also includes a chain tightener having a spring constant and being operatively coupled to the ammunition guide chain. The chain tightener executes a movement in a direction of tightening to increase chain tension in at least a portion of the guide chain and executes a movement opposite the direction of tightening to reduce chain tension in at least a portion of the guide chain. The magazine further includes a hydraulic cylinder at least functionally coupled in parallel to the chain tightener to effectively adjust the spring constant of the chain tightener as a function of the direction of movement of the chain tightener and as a function of a speed of movement of the chain tightener. The hydraulic cylinder includes a return valve which opens when the chain tightener moves in the direction of tightening.

Other features and advantages are inherent in the apparatus claimed and disclosed or will become apparent to those skilled in the art from the following detailed description and its accompanying drawings.

DESCRIPTION OF THE PREFERRED EMBODIMENTS

As used throughout this document, the term "ammunition guide chain" is to be understood only in the figurative sense, since the ammunition can also be guided by belts or bands through the ammunition magazine 2 in an endless loop. The term serves merely for easier readability of the present description, but is not to be understood restrictively.

As used throughout this document, the term "spring constant" denotes merely the proportionality factor (preferably of the first order) between deflection of the chain tightener and the resulting restoring force. This term should not imply that only springs can implement the chain tightener, but again serves merely for easier readability of the present description. In the case wherein a controlled hydraulic cylinder implements the chain tightener, a fixed stipulated relation (perhaps stored beforehand in a table) between the extending and retracting movements of the hydraulic cylinder of this hydraulic chain tightener and the pressure imposed on the cylinder can be employed for the chain tightener. However, a spring device commonly has a stipulated relation between the retracting and extending movements and the restoring force, even if this relation depends on the position and can be set differently for each position. The proportionality factor derivable from the value pair of the position of the retracting and extending movements and the restoring force then acting should define the spring constant.

Figure 1:
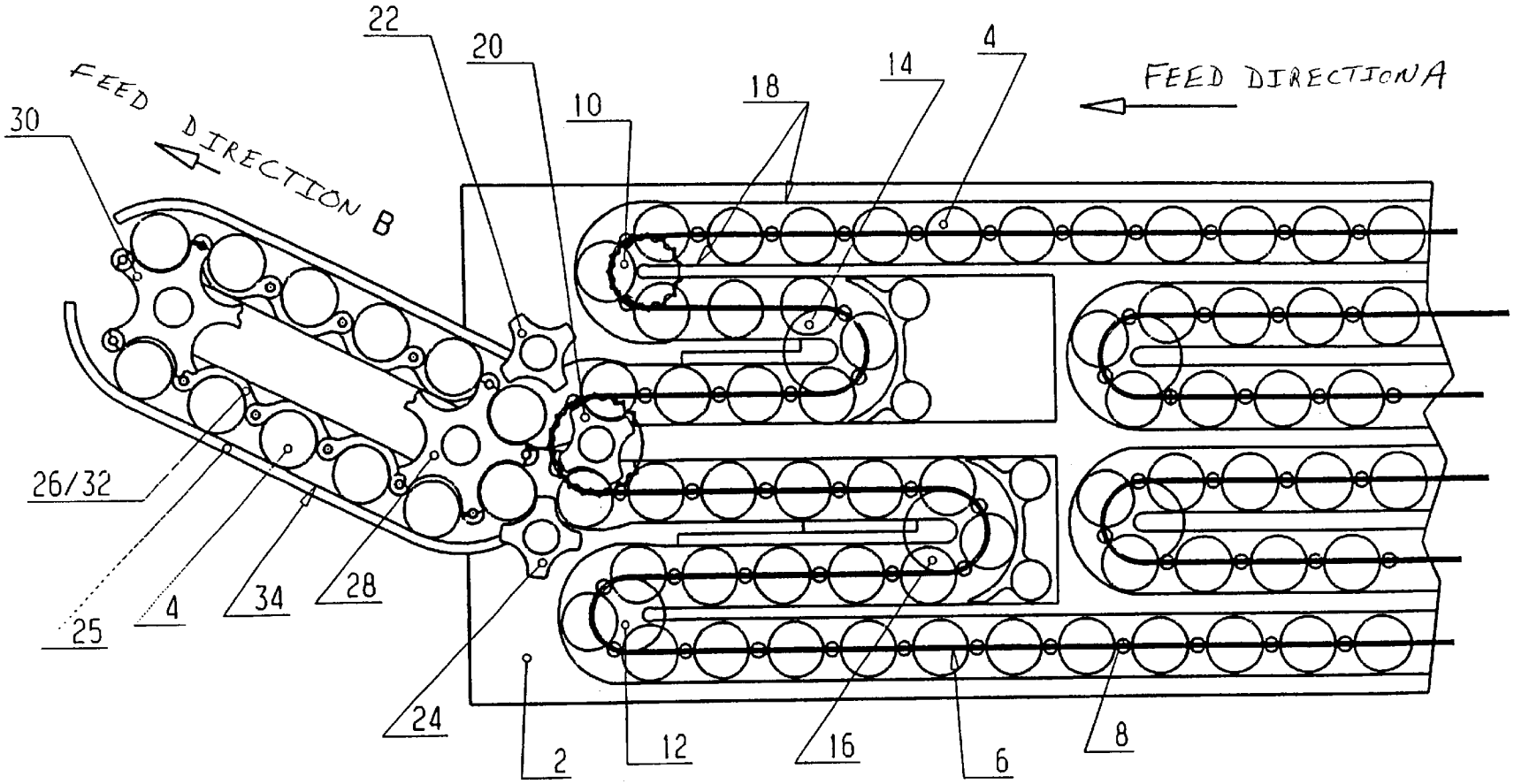
FIG. 1 is a schematic side view of a section of an ammunition magazine constructed in accordance with the teachings of the instant invention.

An ammunition magazine 2 constructed in accordance with the teachings of the invention is depicted in FIG. 1. The magazine 2 includes an endlessly guided ammunition guide chain 6 which conveys cartridges 4 in feed direction A. The ammunition guide chain 6 comprises two high-tensile strength, parallel guided transport chains, whose spacing relative to each other substantially corresponds to the length of the cartridges they are intended to carry. The two parallel transport chains are connected to each other at constant spacing via crosspieces 8. The spacing between adjacent crosspieces 8 is substantially equal to the cartridge diameter plus the diameter of a crosspiece 8 and a certain play for free movement of the guided cartridges 4. The endless ammunition guide chain 6 so formed is guided in several loops over deflection rolls 10, 12, 14 and 16 through the section of ammunition magazine 2 depicted in FIG. 1.

The cartridges 4 within the ammunition magazine 2 are guided in guide tracks 18 with limited free mobility. These guide tracks 18 are provided, for example, with sliding/roller rails made of low-wear plastic. The rigid, thin crosspieces 8 each separate two consecutive cartridges or their casings from each other, and convey these cartridges/casings through the guide track 18 in the ammunition magazine 2.

The crosspieces 8 can each have a profile adapted to the cartridge shape, so that jamming of the cartridges 4 is avoided as much as possible. The crosspieces 8 can also be mounted to rotate axially on the two chains of the ammunition guide chain 6, in order to facilitate rolling of the cartridges 4 within the guide track 18 and, thus, also on the crosspieces 8.

In a center loop of the guide track 18 (in the practical example depicted in FIG. 1 in the left center of ammunition magazine 2), the cartridges are transferred via a feed gear 20 and transfer gears 22, 24 to an ammunition feed device 25. The ammunition feed device 25 has an ammunition feed chain 26 that is guided in an endless loop around a first deflection roller 28 and a second deflection roller 30. The feed chain 26 forms several consecutive shell-like receiving containers 32. The receiving containers 32 are dimensioned so that they can each accept one cartridge 4. The ammunition feed chain 26 is again guided within a guide track 34. A self-loading weapon can be provided in the vicinity of the second deflection roller 30. This weapon accepts the cartridges fed by the ammunition feed chain 26, fires them, and subsequently transfers the empty cartridge casings back to the ammunition feed chain 26.

Thus, during one shooting sequence, cartridges 4 are transported by the ammunition guide chain 6 in feed direction A to the feed gear 20. Each cartridge is then sequentially transferred via the transfer gear 22 to a corresponding receiving container 32 of the ammunition feed chain 26. At the same time, a cartridge lying farther forward (viewed in feed direction B) relative to the feed chain 26 is loaded at the second deflection roller 30 into a weapon (not shown). Simultaneously with the loading of a new cartridge, the cartridge casing remaining from the previous shot is transferred from the weapon to the ammunition feed chain 26. An additional empty cartridge casing may also be transferred by the first deflection roller 28 via the transfer gear 24 to the feed gear 20 and, thus, to the ammunition guide chain 6. The empty cartridge casings are subsequently transported further through the magazine 2 via the deflection rollers 16, 12.

The feed gear 20 and the two transfer gears 22, 24 are connected in shape-mated fashion to the first deflection roller 28. As a result, the loading force of the weapon engaging the magazine 2 via the second deflection roller 30 drives the ammunition feed chain 26, the first deflection roller 28, the two transfer gears 22, 24, the feed gear 20, and also the ammunition guide chain 6.

A large connection angle range of the ammunition feed chain 26 relative to the ammunition magazine 2 can be covered by varying the positions of the first deflection roller 28 and the two transfer gears 22, 24 relative to the feed gear 20.

Figure 2:
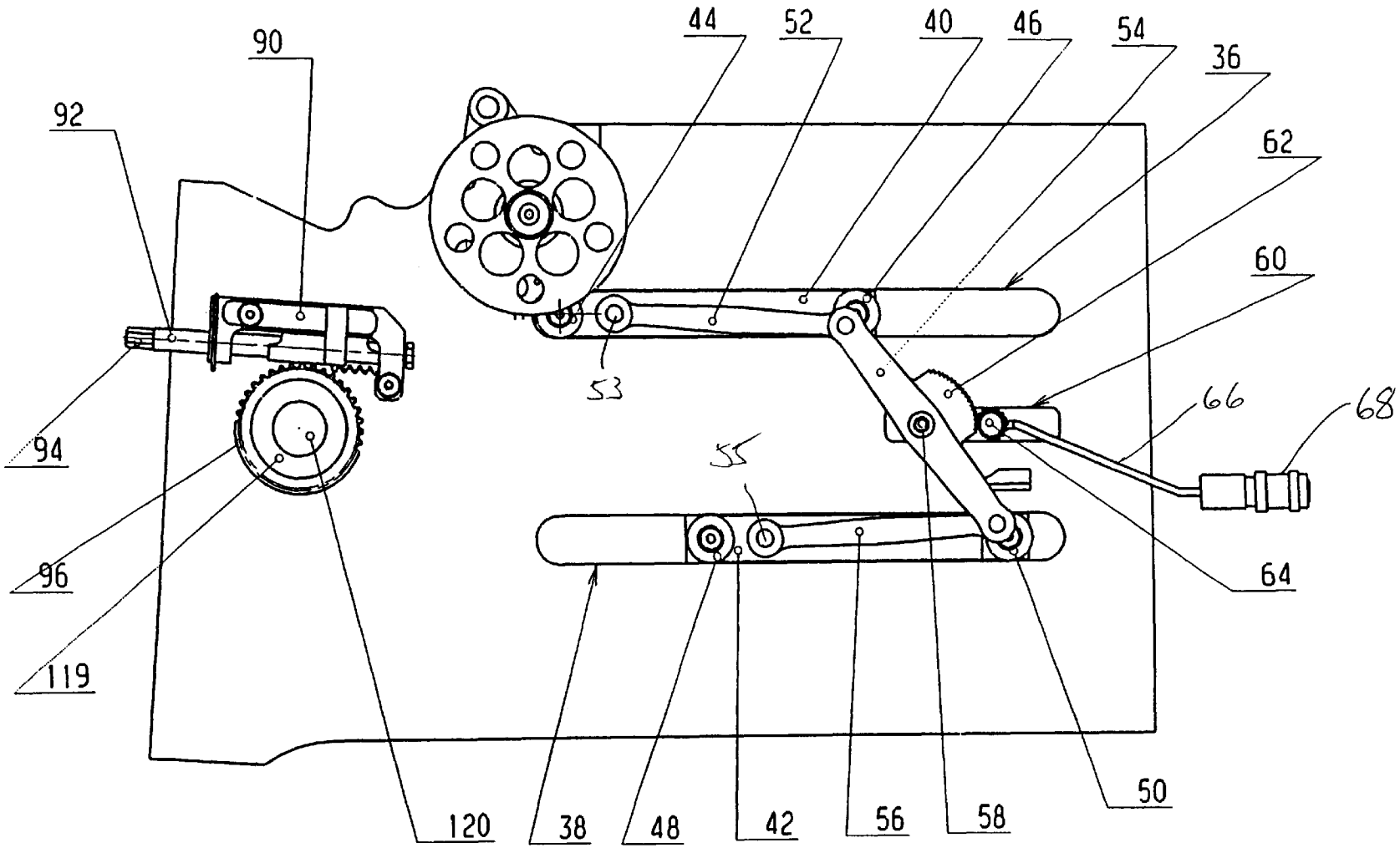
FIG. 2 shows a side view of the ammunition magazine depicted in FIG. 1.

The first and second deflection rollers 14, 16 form a loop of the ammunition guide chain 6 and are arranged to move in the feed direction A of the ammunition guide chain 6. FIG. 2 is referred to for explaining this movement.

FIG. 2 shows a schematic side view of the ammunition magazine 2 depicted in FIG. 1. A first connecting rail 36 and a second connecting rail 38 are provided in the depicted side of the ammunition magazine 2 to respectively accept a first slide 40 and a second slide 42. The first slide 40 is guided to move over rollers 44, 46 in the first connecting rail 36 and carries the axis of the first deflection roller 14. The second slide 42 is similarly guided to move over rollers 48, 50 in the second connecting rail 38 and carries the axis of the second deflection roller 16. One end 53 of a first rod 52 is mounted to pivot on the first slide 40. The other end of the rod 52 is connected to pivot with the first end of a rocker 54. Similarly, one end 55 of a second rod 56 is mounted to pivot on the second slide 42, whereas the second end of the second rod 56 is connected to pivot with the second end of rocker 54. The rocker 54 is, in turn guided to move about a pivot axis 58 in an additional connecting rail 60. To this extent, the ammunition guide chain 6 can be either tightened or loosened via the movable rocker 54, the two rods 52, 56, the two slides 40, 42 and the two deflection rollers 14, 16.

As described above, the weapon can drive the feed gear 20. Typically, the weapon drives the feed gear 20 intermittently in the firing cycle of the cartridges. Within each drive pulse, the ammunition guide chain 6 is initially strongly accelerated and then braked. Due to the numerous cartridges in the ammunition guide chain 6, the inert mass of the guide chain 6 is very high. As a result, strong tensile forces occur in the ammunition guide chain 6 during acceleration of the chain 6. This tensile force during the acceleration phase is compensated by rocker 54. In particular, the first deflection roller 14 is moved leftward during acceleration in the practical example depicted in FIG. 1, so that only the section of the ammunition guide chain 6 situated between the feed gear 20 and the first deflection roller 14 must be accelerated. A slack in the ammunition guide chain 6 is simultaneously formed between the feed gear 20 and the second deflection roller 16, which, however, is compensated by the rocker 54. If the first deflection roller 14 moves leftward in FIG. 1, (i.e., the moving slide 40 moves leftward in FIG. 2), the slide 42 is necessarily moved rightward in FIG. 2 by rocker 54, which again means movement of the second deflection roller 16 in FIG. 1 to the right. With a fixed (i.e., pivotable, but not longitudinally moveable) rocker 54, the slack between feed gear 20 and the second deflection roller 16 developed by shortening of the loop depicted in FIG. 1 between feed gear 20 and the first deflection roller 14 would be precisely eliminated. Similar (but opposite) movements of the rocker 54 and slides 40, 42 occurs when the roller 14 moves rightward.

As shown in FIG. 2, a toothed segment 62 is rigidly connected to rocker 54. A gear 64 engages this toothed segment 62. The gear 64 activates a potentiometer 68 via a transfer linkage 66. The pivot position of the rocker 54 can, therefore, be measured with the device comprising the toothed segment 62, gear 64, transfer linkage 66 and potentiometer 68. The potentiometer 68 is connected as a bridge branch of a conventional Wheatstone Bridge (not shown), whose other bridge branches comprise two series-connected resistors. With appropriate dimensioning of the resistors and potentiometer, the output of the Wheatstone Bridge tapped between the two resistors and the center tap of the potentiometer 68 delivers a current which equals zero in the center position of the rocker 54 and is otherwise positive or negative, depending on the position of the rocker 54. This output signal is fed to a drive (not shown) connected in shape-mated fashion to the deflection roller 10 and, optionally although preferably, to a second drive connected to deflection roller 12. The drive is controlled so that it attempts to pivot rocker 54 back into the rest or zero position when a non-zero output signal is detected.

Persons of ordinary skill in the art will readily appreciate from the foregoing that, instead of this electrically designed control, an appropriately designed hydraulic control could also be provided without departing from the scope or spirit of the invention.

The rocker 54 and the driver deflection roller 10 cooperate to convert the intermittent motion of the ammunition feed chain 26 and the feed gear 20 produced by the weapon to a uniform movement of the ammunition guide chain 6.

Figure 3:
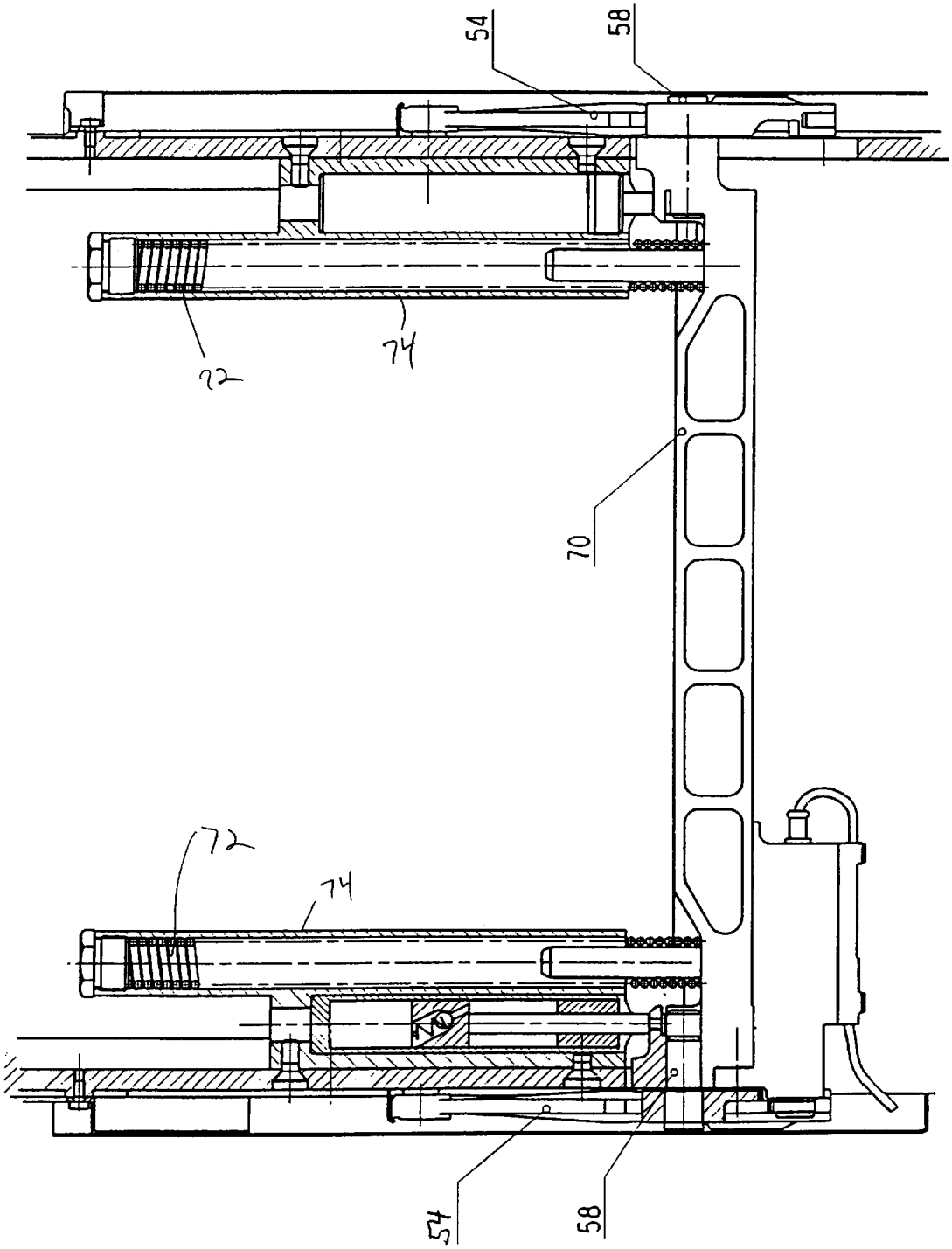
FIG. 3 shows another side view through the ammunition magazine depicted in FIG. 1.
Figure 3A:
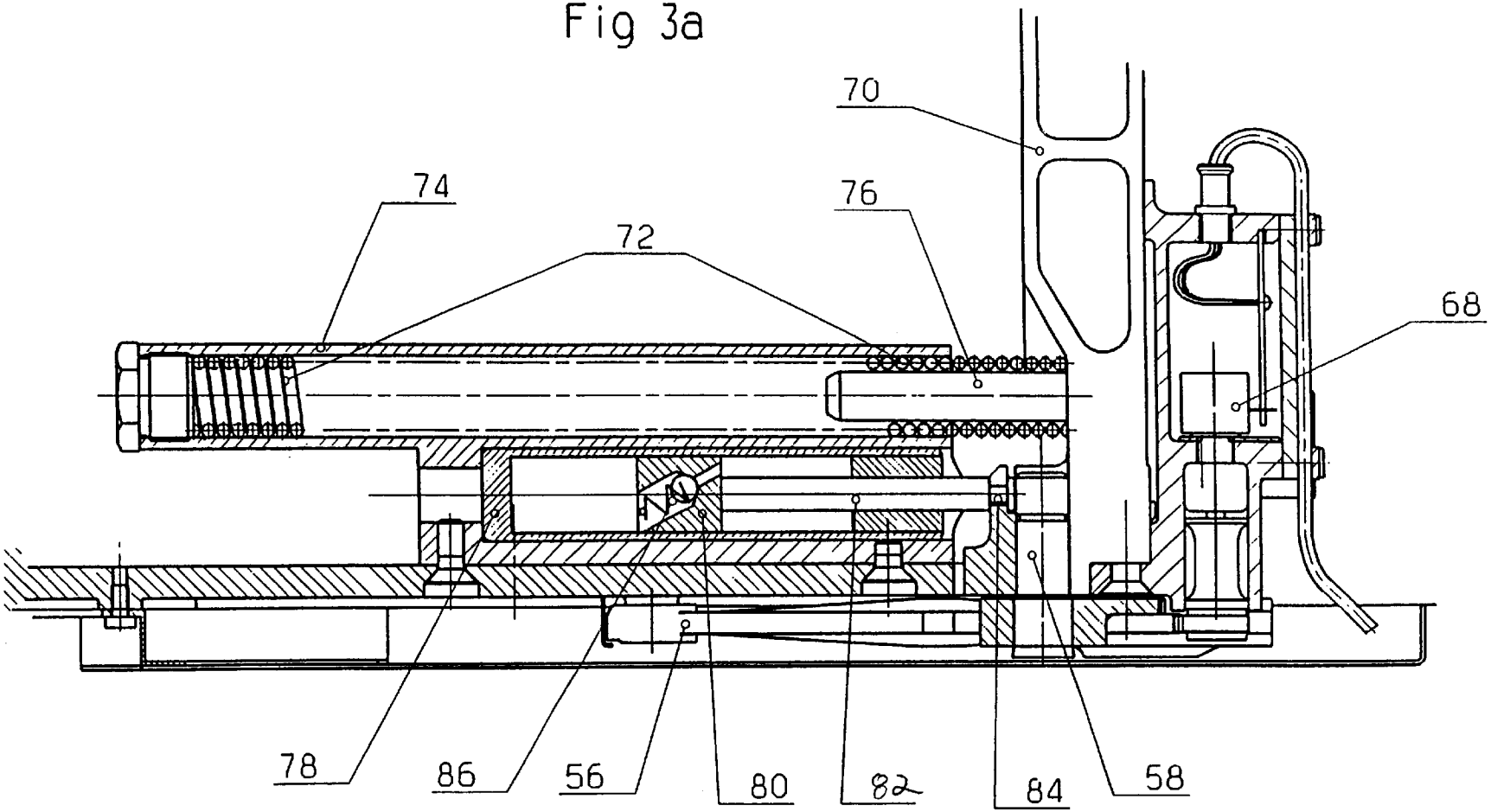
FIG. 3*a* shows an enlarged section of FIG. 3.

FIGS. 3 and 3*a* show a cross section through the ammunition magazine 2. The section is through a center surface along the connecting rail 60 of the rocker 54. In the depicted practical example, a rocker 54 is provided on both side surfaces of the ammunition magazine 2. The corresponding pivot axis 58 of the rockers 54 is mounted in a transverse bridge 70 that connects the two rockers 54 together. The transverse bridge 70 is therefore guided on both sides to move within connecting rails 60.

Chain tension springs 72 act between the rigid housing of the ammunition magazine 2 and a respective end of the moveable cross bridge 70. For this purpose, each chain tension spring 72 is secured in a spring guide cylinder 74 which is rigidly connected to the housing of the ammunition magazine 2. The spring guide cylinder 74 has a free end which is positioned such that it can potentially abut against the cross bridge 70 via a spring guide rod 76. Overall, in the example shown in FIG. 2, the chain tension springs 72 force both rockers 54 rightward in their entirety, so that the two deflection rollers 14, 16 shown in FIG. 1 are also forced rightward. Because of this rightward bias, the ammunition guide chain 6 is prestressed with a certain predefined chain tension. The chain tension is obtained from the spring constant of the chain tension springs 72 and their engagement positions. For ordinary coil springs, the linear Hooke's Law applies over broad ranges of engagement positions.

If the ammunition guide chain 6 is accelerated via the feed gear 20, such strong forces briefly occur in the ammunition guide chain 6 that the tightening force of the chain tension spring 72 is overcome. As a result, the entire rocker 54 is moved leftward in the practical example depicted in FIG. 2, so that an overall slack develops in the ammunition guide chain 6. In the most unfavorable case, the force occurring from the jerky acceleration can force the chain tension spring 72 to collapse such that the stop (i.e., the bridge 70) abuts the spring guide cylinder 74. The still present motion impulse is then taken up at the stop and the entire material of the ammunition magazine 2. This can, at worst, lead to undesired material cracks or breaks.

The expedient of increasing the spring constant of the chain tension spring 72 to such a degree that impact of the bridge 70 on the spring guide cylinder 74 can be essentially ruled out does not lead to the objective here. If such high spring constants are employed, the tightening force exerted by the chain tension spring 72 is already so strong after its engagement over a short zone that the ammunition guide chain 6 is needlessly tightened, so that guide problems and material fatigue can occur. Such a short-zone engagement of the chain tension spring 72, however, can already be caused, for example, by heat-related material expansions, since different materials are used for the housing of the ammunition magazine 2 (aluminum, carbon fiber composite, etc.) and the ammunition guide chain 6 (steel, etc.). To this extent, the spring constant of the chain tension spring 72 should be chosen so that, even during sharp temperature changes and the accompanying engagement and disengagement movements, the tightening force exerted by the chain tension spring 72 on the ammunition guide chain 6 remains in the acceptable range.

In order to nevertheless prevent impact between the spring guide cylinder 74 and the bridge 70 with a chain tension spring 72 so dimensioned, a hydraulic cylinder 78 is provided on both sides of the ammunition magazine 2. As shown in FIG. 3, the cylinder of each hydraulic cylinder 78 is rigidly connected to the spring guide cylinder 74. A piston 80 is guided in the hydraulic cylinder 78 parallel to the direction of action of the chain tension spring 72. A piston rod 82 of a piston 80 is connected to the cross bridge 70 by external force via a T-groove 84. A ball return valve 86 is also provided in the piston 80. This return valve 86 closes during engagement of the piston 80 in the cylinder. The closure movement of the valve 86 is essentially caused by a spring device (FIG. 3*a*). During disengagement of the piston 80, the ball return valve 86 opens because of the hydraulic fluid flowing through a ventilation channel formed in the ball return valve 86 in the hydraulic cylinder 78.

The hydraulic cylinder 78 is dimensioned so that a rapid engagement movement of its piston 80 encounters an essentially infinite resistance. Therefore, during such a rapid engagement movement, the hydraulic cylinder 78 prevents leftward movement of the cross bridge 70 via the piston rod 82 in the practical example depicted in FIG. 3. A rapid movement of the cross bridge 70 leftward would otherwise occur, as described above, in a case in which the feed gear 20 accelerates the ammunition guide chain 6. The hydraulic cylinder 78, therefore, ultimately causes an increase in spring constant of the chain tension spring 72 to an almost infinite value. This corresponds to the case in which the cross bridge 70 and the rocker 54 are rigidly connected to the housing of the ammunition magazine 2. The total acceleration forces generated by the turning feed gear 20 result, therefore, in only a pivoting movement of the rocker 54 and, with appropriate delay, are compensated by the two drives of the deflection rollers 10, 12. In other words, the clamping movement opposite the direction of tightening of the ammunition guide chain 6 is essentially blocked. No slack can therefore develop in the ammunition guide chain 6.

When clamping movements that occur very slowly in time (for example, as caused by material heat expansion) are encountered, the piston 80 can engage (i.e., the bridge 70 can move) without great resistance in the hydraulic cylinder 78, since the gap between the piston 80 and the cylinder is correspondingly dimensioned. For such slow speeds, the hydraulic cylinder 78, therefore, does not pose an additional resistance, so that the spring constant of the chain tension spring 72 essentially assumes its normal value (i.e., its value in the absence of the hydraulic cylinder) for adjustment of the stipulated chain tension.

Should slack develop in the course of acceleration of the ammunition guide chain 6, (i.e., should the chain tension springs 72 be engaged via their position in the normally stressed chain), the restoring force acting from the chain tension spring 72 from the engaged position can fully act on the cross bridge 70, (i.e., with the normal spring constant). The piston 80 experiences no significant resistance during disengagement from the cylinder, since the ball return valve 86 opens during disengagement. In other words, the spring constant during a clamping movement of the chain tension spring 72 is essentially independent of speed and assumes the normal value for adjustment of the stipulated chain tension. This naturally also applies to slow expansion movements, for example, because of material heat expansion of the ammunition guide chain 6, since the resistance of piston 80 during disengagement is essentially independent of speed.

FIG. 2 also shows a chain adjuster 90, which acts on either the feed gear 20 or the first deflection roller 28. The chain adjuster 90 has a pivotable worm gear pair 92 that can be driven by a driveshaft stump 94. A gear rim 96 is rigidly mounted on the axis of the feed gear 20 and the first deflection roller 28, into which the pivoted worm gear pair 92 can engage. The position of the ammunition guide chain 6 can, therefore, be moved by rotating the worm gear pair 92, which, in the pivoted state, rotates the gear rim 96 and thus the feed gear 20 and the first deflection roller 28.

The ammunition supply in the ammunition magazine 2 can be filled up in the shortest time using appropriate ground equipment, (for example, a beltless supply vessel), which operates according to the same functional principle, namely, the empty cartridge casings or misfires can be removed at the same time that new cartridges are loaded. After the filling process, the ammunition guide chain 6 is brought to the appropriate position via the driveshaft stump 94, so that it can cooperate optimally with the self-loading weapon.

Figure 4:
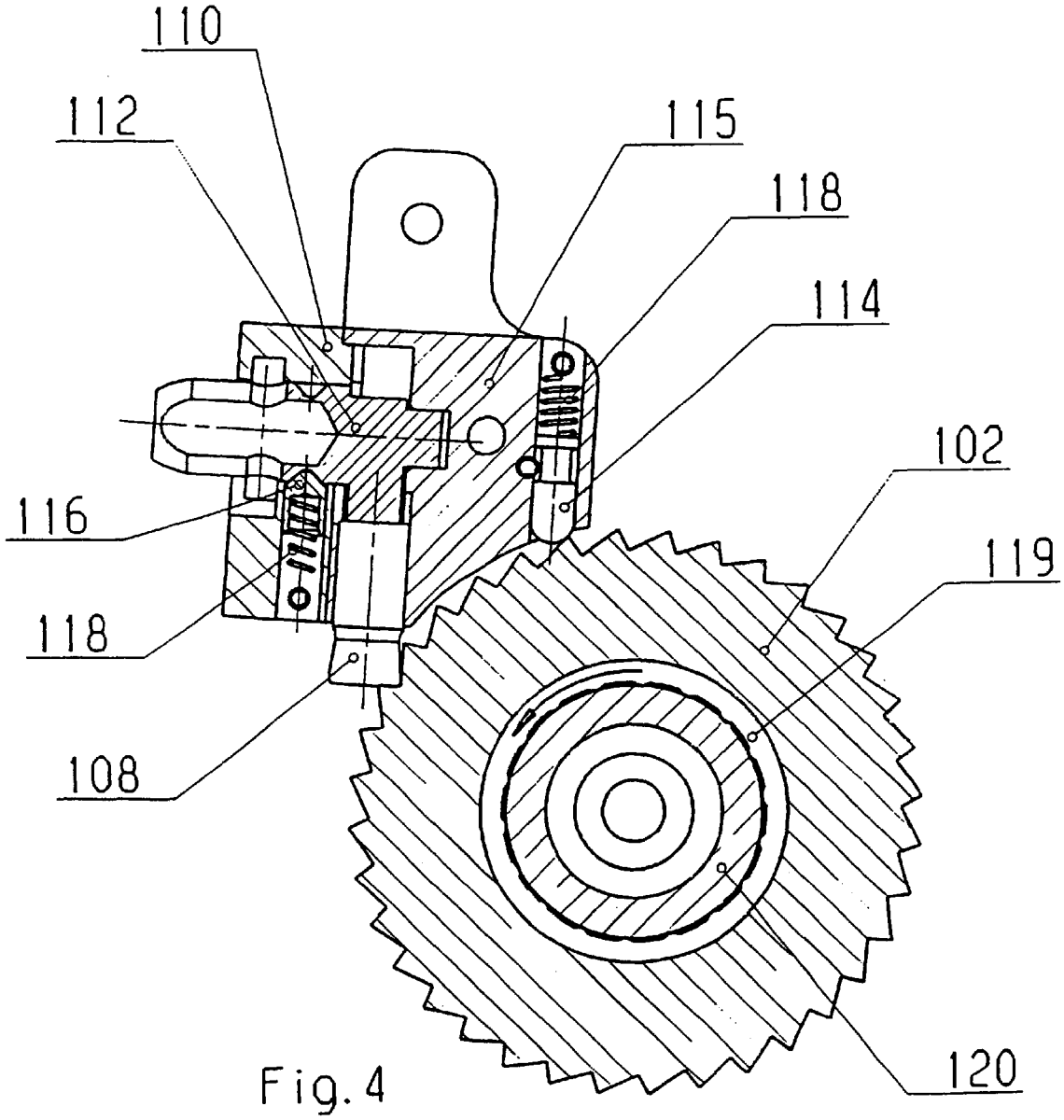
FIG. 4 shows a view of a freewheel with releasable barrier coupled to a deflection roll.

FIG. 4 shows a view of a freewheel 119 with a releasable barrier for the first deflection roller 28. The ammunition feed chain 26 of the ammunition feed device 25 represents an elastic mass during its motion around the two deflection rollers 28, 30. When the deflection roller 30 is driven by the weapon with interruptions, (i.e., briefly accelerated and then braked), the ammunition feed chain 26 is stretched on the cartridge feed side, while it is compressed on the cartridge casing withdrawal side. The first deflection roller 28 is accordingly driven in delayed fashion by the second deflection roller 30 via the ammunition feed chain 26.

The second deflection roller 30 stands still, at times, between shots, whereas the ammunition feed chain 26, because of its inert mass and the restoring forces, still cannot immediately assume its rest position. The compressed or stretched chain sections cause restoring forces in the ammunition feed chain 26 that cause the first deflection roller 28 to experience back-and-forth rotation.

If during subsequent acceleration of the second deflection roller 30, (for example, on the next shot), the ammunition feed chain 26 accelerates on the cartridge feed side in the feed direction B, it can happen in the most unfavorable case that the deflection roller 28 is carrying out a rotational movement in precisely the opposite direction of feed direction B when the roller 30 is accelerated. Since the deflection roller 28 is connected by external force to the feed gear 20 via transfer gears 22, 24 and, thus, to the entire ammunition guide chain 6 in the ammunition magazine 2, a large inert mass is moved during this back-and-forth rotational movement of the deflection roller 28. This inert mass must be overcome by the drive of the deflection roller 30, so that the first deflection roller 28 is first braked and then brought to rotational movement in the direction of feed direction B. Overall, the drive of the deflection roller 30, in this case, must accelerate a very large mass. As a result, this drive has to be very strongly dimensioned and the ammunition feed chain 26 has to be designed to be very strongly loadable.

To avoid this excessive dimensioning, the first deflection roller 28 is rigidly connected to a freewheel 119 (see also FIG. 2), which, as explained below, blocks rotational movement of the first deflection roller 28 against feed direction B. Because of this freewheel 119, no acceleration of the deflection roller 28 or the units connected to it can occur opposite feed direction B, so that the drive of the second deflection roller 30 must always accelerate only the entire inert mass of the ammunition feed chain 26, and need not brake it first.

Since the drive always brings the second deflection roller 30 to a stipulated position, (which is stipulated, for example, by the discharge mechanism of a self-loading weapon), by stretching the ammunition feed chain 26 on the cartridge feed track and the accompanying restoring force, the first deflection roller 28 is then rotated so far in feed direction B that the ammunition feed chain 26 is slightly compressed on the cartridge feed side. Subsequent acceleration of the second deflection roller 30 overall still has to apply less force, since the ammunition feed chain 26 is prestressed positively for this acceleration and can, therefore, furnish part of its chain tension to the acceleration. The chain part on the cartridge casing withdrawal track is simultaneously expanded to the same extent that the part on the cartridge feed side is compressed. For this reason, restoring forces caused by the ammunition feed chain 26 are established on both tracks which support the acceleration caused by rotation of the second deflection roller 30.

The freewheel 119 is not further explained below, since its function and design are well known to persons of ordinary skill in the art from the prior art. Moreover, any other appropriate type of blocking device can be used for freewheel 119 that permits rotation of the first deflection roller 28 in one direction and essentially blocks it in the other direction (preferably rigidly).

If the freewheel 119 is used as the blocking device, its blocking action is substantially not releasable in one direction of rotation without difficulty. Nevertheless, to permit release of this blocking effect of the freewheel 119, the freewheel 119 is connected to an additional releasable barrier that is further explained below with reference to FIG. 4.

FIG. 4 shows such a releasable barrier, which is connected by outside force to the freewheel 119. In particular, whereas the freewheel 119 is rigidly connected to the first deflection roller 28 the freewheel 119 sits in a ratchet wheel 102 such that the freewheel 119 can only move counterclockwise relative to the ratchet wheel 102 and the ratchet wheel 102 can only move clockwise relative to the freewheel 119. A housing 15 of this releasable barrier has a blocking cylinder 108 which is engaged with the ratchet of the ratchet wheel 102. The blocking cylinder 108 has a flat end surface that abuts the steep flanks of a ratchet of the ratchet wheel 102 when the blocking cylinder 108 is extended by an eccentric shaft 112. Clockwise rotation of the ratchet wheel 102 in the practical example depicted in FIG. 4 is thus blocked. Counterclockwise rotation of the ratchet wheel 102 is also blocked by the extended blocking cylinder 108, since its outer surface precisely abuts the flat flank of a ratchet. The releasable barrier therefore blocks movement of the ratchet wheel 102 when the blocking cylinder 108 is extended. Therefore, when the ammunition feed chain 26 is moved either in or against the feed direction B, the ratchet wheel 102 does not rotate. Axis 120 is, therefore, only rotatable in the direction stipulated by freewheel 119 when the ratchet wheel 102 is secured by the blocking cylinder 108.

The blocking cylinder 108 is guided in the housing 115 and can be extended therefrom in a direction which is substantially tangential to the ratchet wheel 102. The extending movement of the cylinder 108 is caused by the eccentric shaft 112, which can be activated by a rotating rod (not shown). A small recess is provided in the eccentric shaft 112, into which a blocking pin 116 can radially engage. This blocking pin 116 is forced into this recess by the spring force of a spring 118. The eccentric shaft 112 is then aligned with the recess, so that the blocking pin 116 engages in the recess when the blocking cylinder 108 is fully extended. This cooperation between the pin 116 and the shaft 112 prevents the eccentric shaft 112 from being unintentionally rotated when the blocking cylinder 108 is extended (and the ratchet wheel 102 is therefore blocked).

The end surface of the blocking pin 116 acting on the eccentric shaft 112 is designed so that, with application of a sufficient torque on the eccentric shaft 112, the recess is freed from the blocking pin 116, so that the eccentric shaft 112 can be rotated and the blocking cylinder 108 can be retracted into the housing 115. The ratchets of the ratchet wheel 102 can then force the blocking cylinder 108 into the housing 115 during clockwise movement of the ratchet wheel 102, so that the blocking effect on the ratchet wheel 102 is eliminated in this direction of rotation.

With the blocking effect on the ratchet wheel 102 released, the first deflection roller 28 can also be rotated against the feed direction B (i.e., since the freewheel 119 is fixed against relative clockwise movement of the ratchet wheel 102, clockwise rotation of the ratchet wheel 102 carries the flywheel 119 and, thus, the deflection roller 28 with it). The freewheel 119 ordinarily blocks such motion, but since it is connected to ratchet wheel 102 in a manner that prevents clockwise movement of the ratchet wheel 102 relative to the freewheel 119, and since the ratchet wheel 102 can now be rotated opposite feed direction B, the blocking effect of the freewheel 119 is effectively eliminated (although there can still be no relative clockwise movement of the wheel 102 relative to the freewheel 119). In this state, the ammunition magazine 2 can be loaded or unloaded, whereupon the position of the ammunition feed chain 26 is established.

If, after the loading or unloading process, the ammunition feed chain 26 is brought back precisely into its position relative to the drive of the second deflection roller 30 (for example, the self-loading weapon), in the most unfavorable case it can happen that the blocking cylinder 108 and a corresponding ratchet of the ratchet wheel 102 are positioned relative to each other so that the eccentric shaft 112 cannot rotate the blocking cylinder 108 into the fully extended position. Moreover, if in this circumstance, sufficient force to overcome the encountered resistance is applied to the extending blocking cylinder 108, the ratchet wheel 102 can be unintentionally rotated in a direction of rotation in which freewheel 119 blocks (i.e., the clockwise direction). If this occurs, however, the first deflection roller 28 and the ammunition feed chain 26 will be moved. If the chain 26 was properly aligned before this movement, it will be misaligned after this movement.

In order to prevent such misalignment during locking of the blocking cylinder 108, an additional cylinder 114 with a hemispherical end surface is provided. This cylinder 114 is also positioned in housing 15 and acts on the ratchets of the ratchet wheel 102. The cylinder 114 is moved by the spring force of a spring 117 in the direction of the ratchets. The hemispherical end surface presses against the ratchets of the ratchet wheel 102, so that the ratchet wheel 102 is always rotated in the counterclockwise direction of rotation, (i.e., the direction in which the freewheel 119 does not block). As a result, only movement of the ratchet wheel 102 occurs, the first deflection roller 28 does not move. The spacing of the two cylinders 108 and 114 is dimensioned so that, if the hemispherical end surface of the retracted cylinder 114 is situated precisely between two ratchets, an optimal position of the blocking cylinder 108 is present with reference to the ratchets, so that the eccentric shaft 112 can fully extend the blocking cylinder 108.

From the foregoing, persons of ordinary skill in the art will readily appreciate that the disclosed ammunition magazine 2 is provided with a chain tightener and means for influencing/adjusting the spring constant of the chain tightener as a function of the direction of tightening and as a function of the speed of the clamping movement. With this expedient, the different motion situations of the ammunition guide chain 6 (e.g., heat-related material expansion, acceleration or braking during firing, etc.), which, in turn, affect the clamping movements of the chain tightener, can advantageously be allowed for, so that slack, in particular, is to a large extent avoided in the ammunition guide chain 6.

This means to adjust the spring constant of the chain tightener can be connected functionally parallel to the chain tightener, so that it can influence the movements of the chain tightener accordingly. From the foregoing, persons of ordinary skill in the art will appreciate that the adjusting means can be implemented by an electromechanical component (like an eddy current brake), that varies its braking force as a function of the direction and speed of the clamping movement. For this purpose, an appropriate conventional measurement device can be provided that detects the movements of the eddy current brake and controls its brake resistance accordingly. Moreover, persons of ordinary skill in the art will also appreciate that the adjusting means could be equivalently implemented by a hydraulic element, whose hydraulic operating pressure is controlled as a function of speed and direction (optionally, also by a measurement device that detects the movement of the hydraulic element). Numerous other equivalent implementations of the adjusting means are also conceivable. By way of example, not limitation, the adjusting means could equivalently be implemented by cylinder-piston arrangements with an appropriate hydraulic fluid, whose viscosity is appropriately adjustable (for example, by electric fields), etc.

Persons of ordinary skill in the art will readily appreciate that the ammunition magazine 2 can also be used to convey and store objects other than cartridges without departing from the scope or spirit of the invention.

The adjusting means preferably influences the spring constant of the tightener so that the spring constant is substantially speed-independent during a clamping movement of the chain tightener in the direction of tightening and assumes a value for adjustment to the predefined chain tension. Thus, during a movement of the ammunition guide chain 6, which causes slack in the chain 6, the spring constant is advantageously not varied, so that the chain tension applied by a clamping movement of the chain tightener can substantially assume its predefined value. To this extent, this special situation is the normal case of a known chain tightener whose spring constant remains unchanged in all situations.

The adjusting means preferably influences the spring constant of the chain tightener so that, during a clamping movement of the chain tightener opposite the direction of tightening at low clamping movement speeds, (e.g., movements responsive to heat-related material expansions), the spring constant substantially assumes the value for adjustment to the predefined chain tension, and, at high clamping movement speeds, (e.g., during a feed movement of the ammunition guide chain 6), the spring constant substantially assumes a high value so that the clamping movement is substantially blocked opposite the direction of tightening. Therefore, during a clamping movement opposite the direction of tightening, two cases are distinguished from each other, namely, that of a slow tightening movement and a fast tightening movement.

During a slow clamping movement (for example, because of heat-related material expansions), the spring constant remains unchanged, so that the chain tension is set as in a known chain tightener without influencing the spring constant. In principle, the spring constant of the chain tightener can be chosen so that, in the range of length changes of the ammunition guide chain 6 that occur because of thermal expansion, the chain tension is not varied too strongly.

On the other hand, at high clamping movement speeds, (i.e., especially during acceleration of the ammunition guide chain 6), the adjusting means influences the spring constant so that the clamping movement is substantially blocked against the direction of tightening. To this extent, this adjusting means acts as a sort of barrier that prevents "contraction" of the chain tightener. This corresponds to the case of an essentially infinitely high spring constant. As a result, no slack can develop in the ammunition guide chain 6.

As an expedient that is particularly simple to design, the chain tightener is implemented by a coil spring device. If other criteria are to be met, the chain tightener can alternatively be implemented by a gas pressure spring or similar device.

The adjusting means is preferably implemented by a hydraulic cylinder 78 coupled functionally parallel to the chain tightener, and the hydraulic cylinder 78 preferably includes a return valve 86 designed so that it opens during a clamping movement in the direction of tightening. A particularly simple embodiment of the adjusting means is advantageously designed in this case. The hydraulic cylinder 78 can be dimensioned so that the force required to extend and retract its piston 80 is essentially zero during slow extension and retraction movements, whereas it is essentially infinite during rapid motion of the piston 80. This can be set, for example, by the gap between the piston and cylinder. The return valve 86 accounts for the case that the hydraulic cylinder 78 is to produce no braking forces against the direction of tightening during a clamping movement of the chain tightener, independently of the speed of the clamping movement, so that the tightening force only depends on the fixed spring constant of the chain tightener.

The chain tightener preferably engages on a movable rocker 54 to tighten the ammunition guide chain 6. Both ends of the rocker 54 are preferably connected to a deflection unit to form a loop with the ammunition guide chain 6. Preferably, a transfer device is provided on the ammunition guide chain 6 to transfer and/or accept ammunition or spent ammunition, which, viewed in the chain trend, is arranged between the two deflection units. With this rocker device known per se, the tensile forces in the chain occurring from acceleration of the ammunition guide chain 6 are taken up by the rocker 54. For this case, the adjusting means blocks the engagement movement of the chain tightener, so that very high tensile forces can occur in the corresponding sections of the ammunition guide chain 6 coupled to the drive. These are now taken up by the rocker 54 and compensated accordingly.

Generally, the transfer device 20 arranged between the two deflection units 14, 16 is coupled to a chain drive so that, for this case, the compensation function of the rocker 54 can be optimally utilized. The transfer device 20, for example, transfers the cartridge to another ammunition feed device 25, which, in turn, transports the ammunition further to a rapid-fire weapon. Synchronously with transfer, the transfer device 20 can receive empty ammunition casings or the like and feed them into the ammunition guide chain 6.

Two drive units are preferably provided to drive the ammunition guide chain 6, which, viewed in the chain trend, are provided in front of and behind the transfer device 20 and, viewed in the chain trend, in front of the first deflection unit 14 and behind the second deflection unit 16. These two drive units are advantageously arranged so that they can drive the portion of the ammunition guide chain 6 which is released from the section of the ammunition guide chain 6 situated between the rocker 54.

Preferably, the ammunition magazine 2 has a measurement device to measure the rocker position and a control device coupled to the measurement device and the two drive units to control the two drive units as a function of the measured rocker position. Both drive units can advantageously be controlled so that they always attempt to bring the rocker 54 to its zero position. The drive units can then accelerate more slowly, so that the acceleration forces acting on the ammunition guide chain 6 are lower. To this extent, the aforementioned released drive of the two sections of the ammunition guide chain 2 is present for this case. Rapid accelerations of the drive of the transfer device 25 are thus taken up in a rocker movement of the rocker 54, which is again compensated more slowly by the two drive units.

From the foregoing, persons of ordinary skill in the art will appreciate that, in the disclosed device an undriven deflection unit 28 is connected to a blocking device that blocks movement of the deflection unit 28 opposite the ammunition feed direction. The blocking device advantageously acts on the undriven deflection unit 28, so that no movement occurs in the direction opposite the feed direction. As a result, the undriven deflection unit 28 need not first be braked, but instead can always be started from a standstill (or from a movement in the ammunition feed direction) of the ammunition feed chain 26. Therefore, the driven deflection unit 30 need only accelerate the entire system in the feed direction and not first brake it. The drive of the driven deflection unit 30 can therefore be advantageously dimensioned weaker. The loads acting on the ammunition feed chain 26 are also lower.

Persons of ordinary skill in the art will appreciate that the ammunition feed device can also be used to convey and store objects other than cartridges without departing from the scope or spirit of the invention. Such persons will also appreciate that all devices that permit rotation in one direction of rotation and block rotation in the other are suitable for use as the blocking device. A ratchet mechanism, etc. can, thus, be used without departing from the scope or spirit of the invention.

Coupling of the undriven deflection unit to the blocking device can optionally occur via a feed shaft connected to the blocking device in shape-mated fashion, but this deflection unit 28 can also be directly coupled to the blocking device.

Movement of the deflection unit 28 opposite the ammunition feed direction B need not be absolutely blocked. For example, it can either be sharply braked or only rigidly blocked after covering a short movement path opposite the ammunition feed direction B. However, this movement is preferably rigidly blocked.

The blocking device that blocks the undriven deflection unit 28 in any rotational position is advantageously implemented by a freewheel 119. The freewheel 119 is advantageous over a ratchet mechanism. For example, a ratchet mechanism blocks only after discrete, not arbitrarily small rotational angle changes, which correspond to the spacings between the individual ratchets. Rotation in both directions is possible within these rotational angle changes. This is not the case in a freewheel 119.

In order to permit adjustment of the ammunition feed chain, (for example, after loading or unloading of the connected ammunition magazine with reference to the insertion mechanism of the self-loading weapon), the blocking device is preferably designed so that its blocking effect (acting opposite the ammunition feed direction), is releasable.

As a particularly space-saving solution, the blocking device preferably has an adjustment device to adjust the position of the ammunition feed chain 26, which can be necessary, for example, after loading of the connected ammunition magazine 2.

In a particularly simple to manufacture embodiment of the adjustment device, the adjustment device advantageously includes an externally activatable worm gear spindle and a gear rim coupled by external force to the undriven deflection unit 28, in which the worm gear spindle engages in the gear rim.

In an advantageously simple to manufacture embodiment of the release mechanism of the blocking device 119, the blocking device 119 is connected to a ratchet wheel 102, in which a corresponding blocking cylinder 108 engages. The blocking cylinder 108 is arranged relative to the ratchet wheel 102, so that it blocks movement of the ratchet wheel 102 when the ammunition feed chain 26 is moved opposite the ammunition feed direction B. The blocking cylinder 108 is preferably designed so that it also blocks the ratchet wheel 102 during movement of the ammunition feed chain 26 in the ammunition feed direction B. The blocking cylinder 108 is also preferably designed as a cylindrical pin with a flat end surface that engages in the ratchet wheel 102. The cylindrical pin can be made to releasably engage the ratchet wheel 102 via an eccentric device 112.

To advantageously prevent the aforementioned release mechanism from misaligning the ammunition feed chain 26 during securing of the release mechanism after setting of the position of the ammunition feed chain 26, a device is provided that brings the blocking cylinder 108 into a defined engagement position in the ratchet wheel 102. This device is preferably a spring-loaded cylindrical pin 114 with a hemispherical end surface that engages in the ratchet wheel 102.

The undriven deflection unit 28 is preferably connected to a transfer device that is designed for exchanging ammunition or spent ammunition with an ammunition magazine 2 connected to the ammunition feed device. The movements of an ammunition guide chain 6, also provided in the ammunition magazine 2, and the movements of the ammunition feed chain 26 are preferably coupled via the transfer device. From the foregoing, persons of ordinary skill in the art will appreciate that back-and-forth movements of the undriven deflection unit 28 are advantageously suppressed; even in the presence of coupled movement of several ammunition feed devices.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use with beltless fed ammunition, an ammunition magazine comprising:

an endless, guided ammunition guide chain to convey ammunition within the magazine;

a chain tightener having a spring constant and being operatively coupled to the ammunition guide chain, the chain tightener executing a movement in a direction of tightening to increase chain tension in at least a portion of the guide chain and executing a movement opposite the direction of tightening to reduce chain tension in at least a portion of the guide chain; and means for effectively adjusting the spring constant of the chain tightener as a function of the direction of movement of the chain tightener and as a function of a speed of movement of the chain tightener.

2. A magazine as defined in claim 1 wherein the adjusting means does not substantially adjust the spring constant of the chain tightener when the chain tightener attempts to increase the chain tension.

3. A magazine as defined in claim 1 wherein, when the chain tightener attempts to reduce the chain tension, the adjusting means does not substantially adjust the spring constant if the speed of movement of the chain tightener is below a first level and the adjusting means substantially increases the spring constant if the speed of movement of the chain tightener is above a second level.

4. A magazine as defined in claim 3 wherein the first level is below the second level.

5. A magazine as defined in claim 3 wherein the adjusting means substantially blocks movement of the chain tightener when the chain tightener attempts to move at a speed above the second level in a direction opposite the direction of tightening.

6. A magazine as defined in claim 1 wherein the chain tightener comprises a spring.

7. A magazine as defined in claim 1 wherein the adjusting means comprises a hydraulic cylinder which is at least functionally coupled in parallel with the chain tightener, and wherein the hydraulic cylinder includes a return valve which opens when the chain tightener moves in the direction of tightening.

8. A magazine as defined in claim 1 further comprising:

a rocker having a first end and a second end disposed on opposite sides of a pivot point, the first and second ends of the rocker being pivotable about the pivot point and the pivot point being translatable; and first and second rollers respectively operatively coupled to the first and second ends of the movable rocker, each of the first and second rollers being coupled to the guide chain to respectively form first and second loops in the guide chain, wherein the chain tightener operatively engages the rocker to tension the guide chain.

9. A magazine as defined in claim 8 wherein pivoting the rocker arm in a first direction increases chain tension in the first loop and decreases chain tension in the second loop, and pivoting the rocker arm in a second direction opposite the first direction increases chain tension in the second loop and decreases chain tension in the first loop.

10. A magazine as defined in claim 8 wherein the chain tightener translates the pivot point of the rocker in a first direction to increase the chain tension and translates the pivot point of the rocker in a second direction to decrease the chain tension.

11. A magazine as defined in claim 8 further comprising a transfer device located between the first and second rollers along the path of the guide chain to transfer at least one of live ammunition and spent ammunition from the guide chain and to deliver at least one of live ammunition and spent ammunition to the guide chain.

12. A magazine as defined in claim 11 further comprising first and second drive units for driving the guide chain, the first and second drive units being located on opposite sides of the transfer device relative to the path of the guide chain.

13. A magazine as defined in claim 8 wherein the first roller is coupled to a first slide and the second roller is coupled to a second slide, the first and second slides being mounted for sliding movement.

14. A magazine as defined in claim 8 further comprising first and second drive units for driving the guide chain, the first drive unit being located upstream of the first roller relative to the path of the guide chain, and the second drive unit being located downstream of the second roller relative to the path of the guide chain.

15. A magazine as defined in claim 14 further comprising:

a measurement device cooperating with the rocker to develop a signal representative of a measured position of the rocker; and a control device connected to the measurement device and to at least one of the first and second drive units, the control device being responsive to the signal to control at least one of the first and second drive units as a function of the measured position of the rocker.

16. A magazine as defined in claim 10 further comprising:

a drive unit for driving the guide chain;

a measurement device cooperating with the rocker to develop a signal representative of a measured position of the rocker; and a control device connected to the measurement device and the drive unit, the control device being responsive to the signal to control the drive unit as a function of the measured position of the rocker.

17. A magazine as defined in claim 11 adapted for use with a weapon, the magazine further comprising:

a first feed roller and a second feed roller;

an endless ammunition feed chain cooperating with the first and second feed rollers, the first feed roller being intermittently driven to feed ammunition into the weapon; and a blocking device cooperating with the second feed roller to substantially prevent the second feed roller from rotating in a direction opposite a direction in which the ammunition is fed to the weapon.

18. A magazine as defined in claim 17 wherein the endless ammunition feed chain receives the at least one of live ammunition and spent ammunition from the transfer device and delivers the at least one of live ammunition and spent ammunition to the transfer device.

19. A magazine as defined in claim 17 wherein the second feed roller is not driven.

20. An ammunition magazine comprising:

an ammunition guide chain to convey ammunition within the magazine;

a chain tightener having a spring constant and being operatively coupled to the guide chain, the chain tightener executing, a movement in a first direction to increase chain tension in at least a portion of the guide chain and executing a movement in a second direction substantially opposite the first direction to reduce tension in at least a portion of the guide chain, and a brake cooperating with the chain tightener to effectively increase the spring constant of the chain tightener in response to forces which, in the absence of the brake, would move the chain tightener in the second direction at a speed above a predetermined threshold.

21. An ammunition magazine as defined in claim 20 wherein the brake does not substantially effectively increase the spring constant of the chain tightener in response to forces that move the chain tightener in the second direction at a speed below the predetermined threshold.

22. An ammunition magazine as defined in claim 20 wherein the brake does not substantially effectively increase the spring constant of the chain tightener in response to forces that move the chain tightener in the first direction.

23. A magazine as defined in claim 20 further comprising:

a rocker having a first end and a second end disposed on opposite sides of a pivot point, the first and second ends of the rocker being pivotable about the pivot point and the pivot point being translatable; and first and second rollers respectively operatively coupled to the first and second ends of the movable rocker, each of the first and second rollers being coupled to the guide chain to respectively form first and second loops in the guide chain, wherein the chain tightener operatively engages the rocker to tension the guide chain.

24. A magazine as defined in claim 23 wherein pivoting the rocker arm in a first direction increases chain tension in the first loop and decreases chain tension in the second loop, and pivoting the rocker arm in a second direction opposite the first direction increases chain tension in the second loop and decreases chain tension in the first loop.

25. A magazine as defined in claim 23 wherein the chain tightener translates the pivot point of the rocker in a first direction to increase the chain tension and translates the pivot point of the rocker in a second direction to decrease the chain tension.

26. For use with beltless fed ammunition, an ammunition magazine comprising:

an endless, guided ammunition guide chain to convey ammunition within the magazine;

a chain tightener having a spring constant and being operatively coupled to the ammunition guide chain, the chain tightener executing a movement in a direction of tightening to increase chain tension in at least a portion of the guide chain and executing a movement opposite the direction of tightening to reduce chain tension in at least a portion of the guide chain; and a hydraulic cylinder at least functionally coupled in parallel to the chain tightener to effectively adjust the spring constant of the chain tightener as a function of the direction of movement of the chain tightener and as a function of a speed of movement of the chain tightener, the hydraulic cylinder including a return valve which opens when the chain tightener moves in the direction of tightening.

* * * * *

UNITED STATES PATENT AND TRADEMARK OFFICE

CERTIFICATE OF CORRECTION

PATENT NO. : 6,405,629 B1
DATED : June 18, 2002
INVENTOR(S) : Beckmann et al.

It is certified that error appears in the above-identified patent and that said Letters Patent is hereby corrected as shown below:

Title page,
Insert the following:
-- [30] Foreign Application Priority Data
January 28, 1999 (DE) ……..199 03 347.1 --

Column 16,
Line 65, after "the guide chain" delete "," and insert -- ; --.

Signed and Sealed this

Twenty-fifth Day of February, 2003

JAMES E. ROGAN
*Director of the United States Patent and Trademark Office*